US006663097B2

(12) United States Patent
Bantle

(10) Patent No.: US 6,663,097 B2
(45) Date of Patent: Dec. 16, 2003

(54) DEVICES FOR FEEDING SHEETS OF A RECORDING MEDIUM

(75) Inventor: Ludwig Bantle, Bosingen (DE)

(73) Assignee: BDT Buro-und Datentechnik GmbH & Co KG, Rottweil (DE)

( * ) Notice: Subject to any disclaimer, the term of this patent is extended or adjusted under 35 U.S.C. 154(b) by 0 days.

(21) Appl. No.: 09/820,491

(22) Filed: Mar. 28, 2001

(65) Prior Publication Data

US 2001/0028143 A1 Oct. 11, 2001

(30) Foreign Application Priority Data

Apr. 5, 2000 (DE) ..... 100 16 793

(51) Int. Cl.[7] ..... B65H 3/04
(52) U.S. Cl. ..... 271/34
(58) Field of Search ..... 271/34, 35, 113, 271/123

(56) References Cited

U.S. PATENT DOCUMENTS

| | | | | |
|---|---|---|---|---|
| 1,427,357 A | | 8/1922 | Caughey | |
| 3,944,214 A | | 3/1976 | Fallos | 271/10 |
| 4,175,741 A | * | 11/1979 | Colglazier et al. | 271/113 X |
| 4,861,012 A | | 8/1989 | Shimizu | 271/3.1 |
| 5,039,078 A | * | 8/1991 | Blessing et al. | 271/34 X |
| 6,378,859 B1 | * | 4/2002 | Lubben et al. | 271/34 X |

FOREIGN PATENT DOCUMENTS

| | | | |
|---|---|---|---|
| DE | 4326026 | 8/1993 | B65H/9/16 |
| DE | 4444836 | 12/1994 | B65H/3/06 |
| GB | 1427357 | 3/1976 | B65H/3/02 |

OTHER PUBLICATIONS

F. Deaton and D.S. Ehn, *Spray–coated Paper Feed Rolls*, IBM Technical Disclosure Bulletin, 25, No. 7B, p. 3976.

* cited by examiner

*Primary Examiner*—David H. Bollinger
(74) *Attorney, Agent, or Firm*—Baker Botts L.L.P.

(57) ABSTRACT

A device for feeding sheets of a recording medium from a stack to an office machine, having movable elements which are moved by way of driven continuously rotating traction devices in the feed direction over the respective top sheet of the stack. The movable elements are supported by guide skids and are in contact with the top sheet under pressure to separate the top sheet from the second sheet of the stack beneath it and displace the top sheet with respect to the second sheet in the direction of feed. The movable elements each have at least one roller arranged across the direction of feed, mounted so it can rotate freely on a traction device.

14 Claims, 3 Drawing Sheets

DEVICES FOR FEEDING SHEETS OF A RECORDING MEDIUM

CROSS-REFERENCE TO RELATED APPLICATIONS

This application is a United States national phase application of pending German Application Serial No. 100.16 793.4, filed Apr. 5, 2000, and herein claims priority of to the afore-referenced pending application.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

This invention relates to a device for feeding sheets of a recording medium from a stack to an office machine according to the definition of the species of claim 1.

In the case of office machines which process individual sheets of a recording medium, in particular paper sheets, it is necessary to feed the sheets which are kept in a stack individually to the office machine.

To do so, it is known that separating rollers can be made to act in a frictionally engaged manner on the top sheet of the stack, pushing the top sheet against separation comers so that the top sheet springs over the separation corners and is separated from the following second sheet of the stack. This single feed by means of separation corners depends greatly on the properties of the sheet, in particular the stiffniess of the sheet. Therefore, this device is suitable only for a relatively narrow range of sheet qualities.

The sheet quality, i.e., its stiffness, the paper weight, etc., are less influential in separation and single feed of sheets where pressure is applied over the top sheet of the stack to cause the sheet to form a wave (wave generator), thereby releasing it from the following second sheet of the stack. The top sheet released from the second sheet in this way is at the same time advanced forward away from the stack and sent to the office machine.

2. Related Art

A device of the generic type defined in the preamble based on this principle is known from German Patent 178,765. With this device, shingling parts made of steel are mounted on a continuously rotating chain and are guided over the top sheet of the stack under pressure and supported by a guide skid. Such shingling parts guided over a sheet under pressure may cause pressure marks and traces on the surface of the sheet. This is a disadvantage especially when working with grades of paper having a sensitive surface, e.g., supercalendered paper. In addition, it is known that rollers which are mounted so they can rotate may be passed over the top sheet as shingling elements. To do so, the rollers are mounted on the periphery of a rotationally driven disk. According to German Patent 205,058, the disk rotates about an axis parallel to the plane of the sheet and perpendicular to the direction of feed. According to German Patent 164,228, the disk is arranged in the same way, and the rollers mounted on its periphery are also spring-mounted radially. According to U.S. Pat. No. 4,165,870, the disk can rotate about an axis perpendicular to the plane of the sheet and the direction of feed, whereby the rollers running in the direction of feed can be brought in contact with the top sheet of the stack by tilting the axis. The use of rotationally mounted rollers as shingling elements reduces the problem of pressure marks and traces, but it cannot completely eliminate it in the case of sensitive paper surfaces. Because of the arrangement of rollers on the periphery of a disk, the rollers engage with the top sheet of the stack only over a very short distance in the direction of feed. Therefore, to generate a flexing effect sufficient to loosen the top sheet, a relatively high pressure of the rollers on the sheet is necessary, but this in turn results in more pressure marks.

A device of is disclosed which may enable a wide range of sheet qualities to be separated for single feed and fed to the machine reliably, while preventing most pressure marks on a surface of the sheets.

BRIEF DESCRIPTION OF THE DRAWINGS

This invention is explained in greater detail below on the basis of an embodiment which is illustrated in the drawings, which show.

DETAILED DESCRIPTION OF THE PREFERRED EMBODIMENTS

Figure 1:
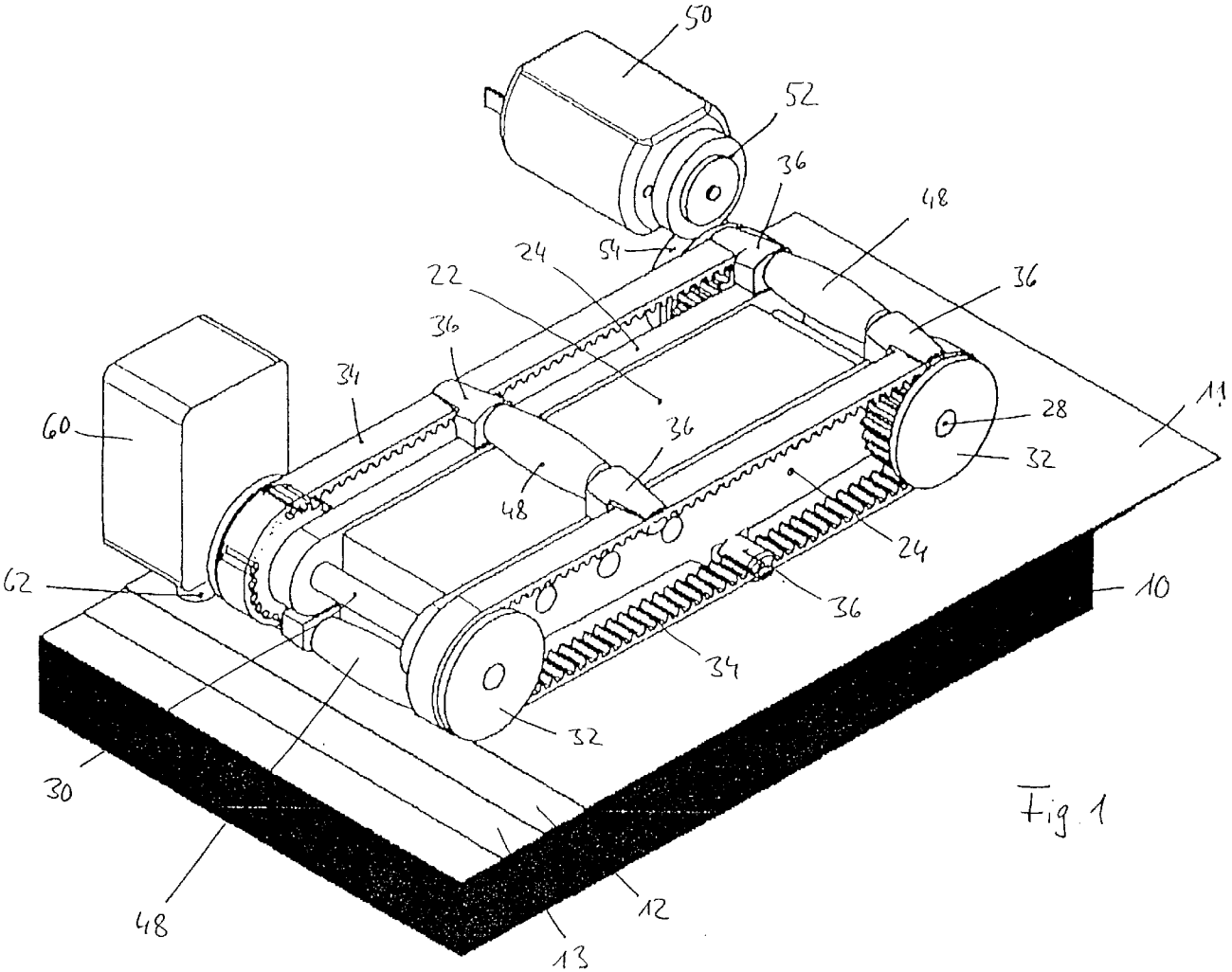
FIG. 1: a perspective view of the device with the housing removed.
Figure 2:
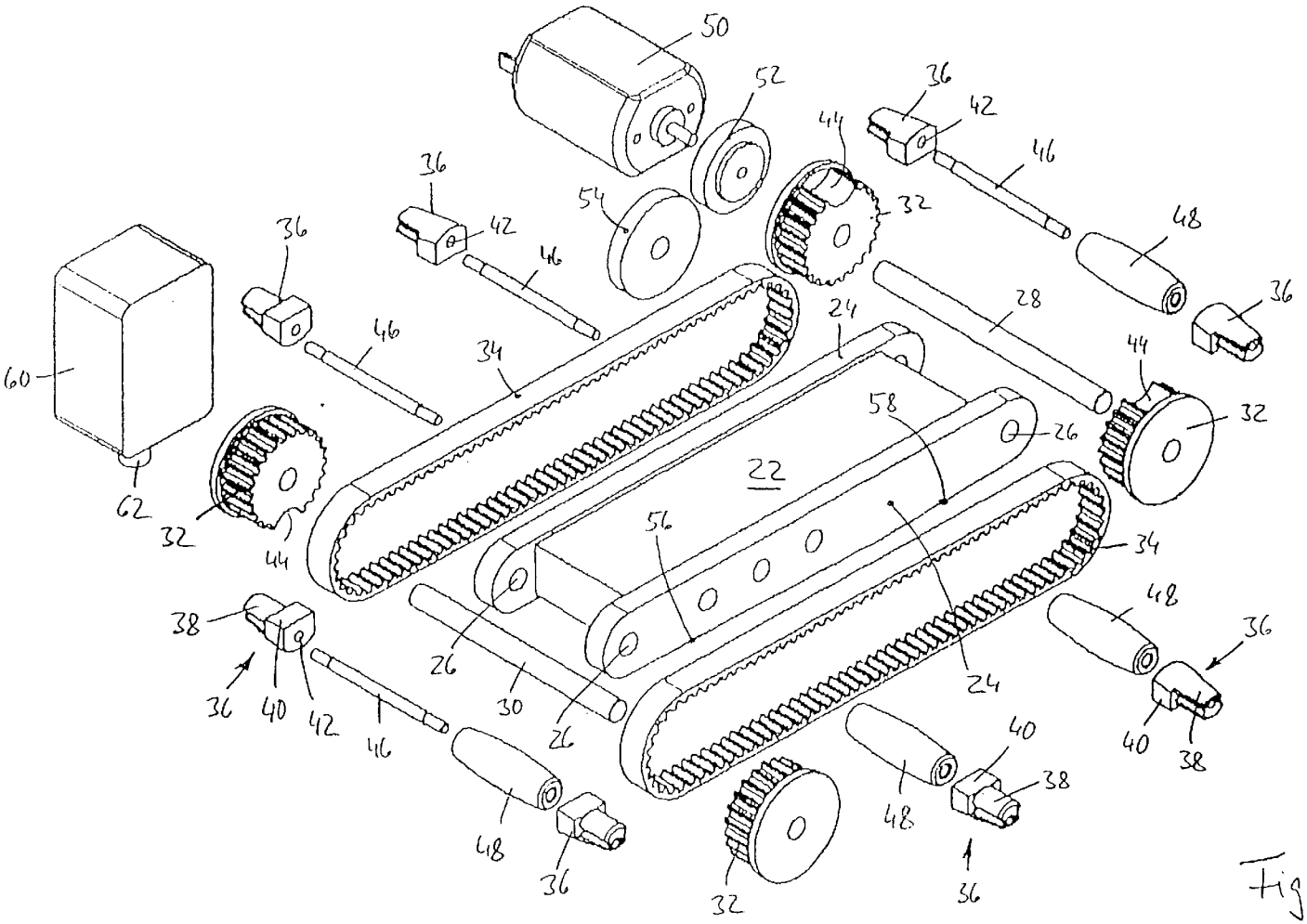
FIG. 2: an exploded diagram of the device.
Figure 4:
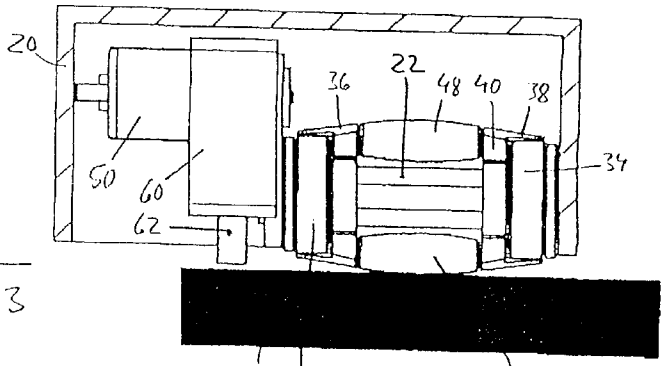
FIG. 4: a view of the device from the rear end.
Figure 3:
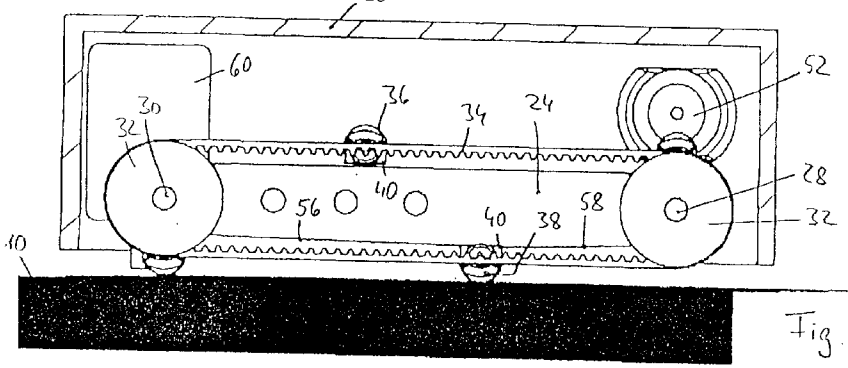
FIG. 3: a side view of the device.
Figure 5:
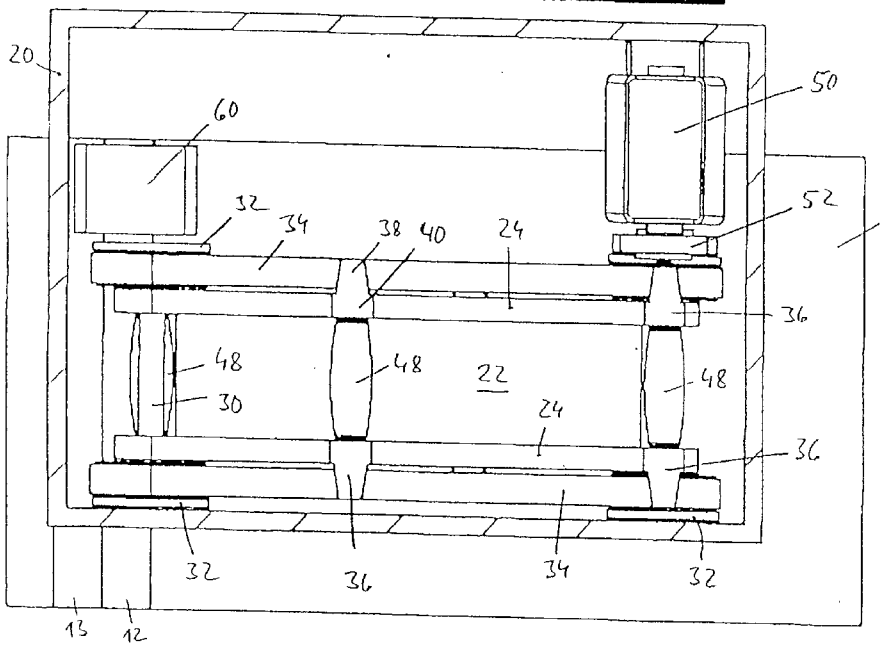
FIG. 5: a top view of the device.

The device may use as the shingling elements rollers which are mounted to rotate freely on an axle. The axles are attached at both ends to continuously rotating traction means and are supported on guide skids. This makes it possible to use wide rollers which can press on the top sheet of the stack over their entire width without a tendency to tilt. The rollers may act over a longer distance. This yields an intense flexing effect, even if the contact pressure of the rollers is relatively low. Therefore the device can be used for a wide range of paper varieties, i.e., for papers with a wide range of different stiffniess values and weights. There are fewer pressure marks due to the reduction in the required contact pressure of the rollers.

In an advantageous embodiment, the development of pressure marks can be further reduced by the fact that the rollers or the guide skids supporting their axles have two successive and connected sections in the direction of movement of the rollers, namely a first section which approaches the plane of the top sheet, and a second section running parallel to this plane of the sheet. The rollers are first supported by the first section, so that at their periphery they approach the surface of the top sheet at first slowly, then come in contact with this surface gently and apply increasing pressure to the surface of the sheet only with further movement. The intense flexing effect with the full contact pressure of the rollers then takes place in the second section. It has been found that the development of pressure marks can be reduced significantly by this asymptotic action of the rollers on the sheet surface. Therefore, this device is especially suitable for sheets having a highly sensitive surface such as supercalendered grades of paper. Since the rollers do not suddenly come in contact with the surface of the sheet in this embodiment, annoying noise production is also avoided.

In addition, the prevention of pressure marks can also be promoted by the fact that the rollers are designed with a slight camber. The contact pressure then decreases continuously from the center of the roller toward its axial ends, and there is no sudden change in contact pressure which would promote the development of pressure marks at the axial ends of the rollers in particular. In addition, the rollers may have a jacket or a shell coating of a soft elastic material to further reduce the development of pressure marks. In an expedient embodiment, the axles of the rollers are mounted on the traction means in such a way that the axles are in a plane in which the traction means exert a tensile force on the axle. This ensures that no tilting moment will be exerted on the rollers due to the tensile force, in particular when the rollers are placed on the sheet.

The number of rollers and thus their mutual spacing are selected by taking into account two conditions in particular. First, the distance should be great enough so that the sheet can bulge between the rollers, thus permitting a good flexing effect. Secondly, the distance between the rollers should be only great enough so that two rollers are always sitting on the surface of the sheet. This guarantees that the support of the device on the sheet surface will always be uniform and noise-generating rattling of the device on the stack of sheets is prevented.

A flexible safety belt rotating continuously may also be wrapped around the rollers. The rollers may then pass over this safety belt in the same manner as the crawler chain of a track-laying vehicle. The safety belt runs loosely with the rollers as the rollers move, and thus it causes the top sheet of the stack to be entrained. The pressure of the rollers is exerted on the safety belt and acts on the top sheet through this safety belt. The safety belt distributes the pressure of the rollers and also makes it more uniform, thus further reducing sudden changes in contact pressure which lead to pressure marks.

To feed single sheets of a recording medium, e.g., paper sheets, to an office machine (not shown in the drawing) such as a printer, a copier or the like, these sheets are kept in a supply stack 10. Sheets 11, 12, 13, etc. are pulled individually from the top of the stack and fed to the office machine (at the right in the diagram in FIG. 1). As soon as the top sheet 11 has been shifted a sufficient distance away from the stack, this sheet is picked up by the conveyer rollers (not shown) which convey the sheet 11 further.

A device which is provided for separating and feeding of sheets 11, 12, 13 is placed on the top of the top sheet 11 of the stack 10 and is held in this position by a holder (not shown in the drawing). This device is enclosed in a box-shaped housing 20 which is open on the bottom side facing stack 10.

A supporting part 22 having a plate parallel to the plane of the top sheet 11 is arranged at the bottom of housing 20. One guide skid 24 is mounted on each of the two longitudinal sides of supporting part 2 running in the direction of feed of sheets 11, 12, 13. Guide skids 24 each project beyond the front end (at the right in the drawing) and the rear end (at the left in the drawing) of the supporting part 22. A bearing hole 26 is provided in the ends of the guide skids 24 projecting above the supporting part 22. Shafts 28 and 30 are mounted in the bearing holes 26. Shafts 28 and 30 run parallel to the front and rear transverse edges of the supporting part 22 and project beyond the guide skids 24 on both sides. Deflecting toothed disks 32 are placed on the ends of shafts 28 and 30 and are secured so that they cannot rotate.

Continuous toothed belts 34 with internal toothing run as traction means over deflecting toothed disks 32 and engage with the deflecting toothed disks 32. Toothed belts 34 are held tightly by the deflecting toothed disks 32 and rotate in a vertical plane adjacent to guide skids 24 and outside said guide skids 24.

Bearing bushes 36 are placed on toothed belts 34. Bearing bushes 36 are slotted axially in their outer area so that two gripping jaws 38 are formed. The bearing bushes are pushed from the side of supporting part 22 onto the toothed belt 34 with these gripping jaws 38; the gripping jaws 38 engage in a form-fitting manner with the teeth of the toothed belt 34, so that bearing bushes 36 are undisplaceably and unpivotably secured on toothed belt 34. The bearing bushes 36 are designed as a sliding block 40 connected to the gripping jaws 38 facing outward. Sliding block 40 is essentially in the shape of a cube. A bearing bore 42 is shaped in the inside end face of each sliding block 40 facing the supporting part 22. Bearing bushes 36 with gripping jaws 38 and sliding block 40 are each produced as a one-piece plastic injection molded part.

Bearing bores 42 are arranged in bearing bushes 36 in such a way that their axis is in the plane of toothed belt 34 when bearing bush 36 is pushed onto the respective toothed belt 34. In their crown rim, each deflecting toothed disk 32 has recesses 44 with which the gripping jaws 38 of the bearing bushes 36 placed on the toothed belt 34 can engage when the area of toothed belt 34 which is equipped with a bearing bush 36 passes over the respective deflective toothed disk 32.

In assembly of the device, bearing bushes 36 are placed on the respective toothed belt 34 in such positions that opposing bearing bushes 36 are aligned axially with their bearing bores 42 on the two toothed belts 34. An axle 46 is inserted into the bearing bores 42 of the opposing bearing bushes 36. A roller 48 is mounted so it can rotate freely on each axle 46. Rollers 48 are designed with a slight camber, so their greatest diameter is in the central axial area, with the diameter decreasing toward the axial ends. Rollers 48 extend axially from one bearing bush 36 to the other bearing bush and thus over the entire width of supporting part 22 between guide skids 24. Rollers 40 are preferably covered or coated with a jacket made of a soft elastic material such as a rubber.

The continuously rotating toothed belts 34 are driven by the deflecting toothed disk 32 sitting on the front shaft 28. Therefore, housing 20 contains an electric motor 50, with a driven gear wheel 52 that engages with a gearing toothed wheel 54, which in turn drives the deflecting toothed disk 32, sitting on its driven shaft. Deflecting toothed disks 32 sitting on the front shaft 28 are driven in this way and in turn drive the toothed belt 34. Deflecting toothed disks 32 sitting on the rear shaft 30 are entrained by the toothed belt 34 so they run freely.

When the toothed belts 34 are driven to rotate by electric motor 50, the bearing bushes 36 placed on toothed belt 34 slide with their respective sliding block 40 on the upper or lower peripheral surfaces of guide skids 24. The lower peripheral surface of guide skids 24 facing the stack 10 has two sections in its longitudinal direction, i.e., in the direction of feed of sheets 11, 12, 13, said two sections being interconnected, one developing into the other. The first section 56, i.e., the left section in the drawing, is inclined slightly toward the plane of the top sheet 11 of the stack 10 so that the guide skid 24 maintains a slightly greater distance from the top sheet 11 at its left end than in the middle area of guide skid 24 where the first section 56 develops into the second section 58. The second section 58 which extends slightly over the right half of guide skid 24 in the drawing is designed to be parallel to the surface of the top sheet 11.

Preferably four rollers 28 are mounted at equal mutual spacing on toothed belt 34. This guarantees that in any position of toothed belts 34, two rollers 48 will be on the lower part of the rotating toothed belt 34 facing the stack.

Finally, the housing 20 also contains an electromagnetically operable braking device 60. Braking device 60 is mounted at the rear end of housing 20 (at the left in the drawing). Braking device 60 has a brake element 62 which can move down toward the stack 10 in a process that is controlled by braking device 60, and then it can sit on stack 10 with frictional engagement.

This device may function as follows:

After inserting stack 10 into the magazine of the office machine, the device is placed on the top sheet 11 of stack 10. The position of the device with respect to the plane of the top sheet 11 is secured by its holder. In the vertical direction, the device sits on stack 10 under its own weight. A means for relieving the weight may be provided if necessary to reduce the contact pressure of the device on the stack, or a spring bias tension can increase the contact pressure.

To feed the sheets from stack 10 individually to the office machine, electric motor 50 is started to drive the toothed belt 34, which rotates counterclockwise in the drawing. Rotating toothed belts 34 entrain rollers 48 which are attached to the toothed belts, so the rollers move from the top part of toothed belt 34 around the rear deflector toothed disks 32. Then rollers 48 reach the bottom side facing stack 10. Bearing bushes 36 first slide along the first section 56 of the guide skids 24 with the respective sliding block 40. Since the guide skids 24 are at first a greater distance away from top sheet 11 in this first section 56, rollers 48 do not yet come in contact with the top sheet 11 immediately after their movement about deflector toothed disk 32. However, when the rollers then move forward along the first section 56 (toward the right in the drawing), rollers 48 slowly approach the surface of top sheet 11 and are set down gently on this surface. With further movement, the contact pressure of roller 48 on the top sheet 11 increases due to the reduction in distance of guide skids 24 from top sheet 11. In the area where the first section 56 develops into the second section 58, the roller has reached its full contact pressure. This contact pressure is maintained over the entire length of the second section 58 of guide skids 24. In doing so, roller 48 exerts the desired flexing shingling effect on the top sheet 11. Due to this flexing motion, the top sheet 11 is loosened from the following second sheet 12 and is displaced by the rollers 48 toward the right the direction of feed toward the office machine, as illustrated in FIG. 1. Since the second section 59 of the guide skids 24 takes at least about half of the length of the guide skids 24 and since four rollers 48 are arranged on toothed belt 34, this guarantees that one roller 48 will always be in the area of the second section 58 of the guide skids 24 in the rotation of toothed belt 34. This roller 48 defines the distance of the device from the surface of the top sheet 11. This guarantees that the device will always be held at the same distance from the top sheet 11 and that no vertical "vibrating" movement of the device will occur due to the transition in engagement from one roller 48 to the next roller 48.

As soon as the top sheet 11 has been displaced due to the flexing shingling motion of rollers 48 so far from stack 10 in the direction of feed that its trailing edge (at the left in the drawing) has pulled out beneath brake element 62 of braking device 60, the braking device is actuated by means of, for example, optoelectric scanning of the front edge of top sheet 11. This lowers the brake element 62 so that it then sits on the rear edge of the second sheet 12 which is then exposed, and presses it against the stack 10. The second sheet 12 is secured by brake element 62 in this way, while the top sheet 11 is conveyed further and is picked up and removed by the downstream conveyer rollers.

Optionally, the device may also be lifted up from the top sheet 11 of the stack 10 by means of the braking device 60 as soon as the forward edge of the top sheet 11 is gripped by the downstream conveyer rollers, as described in German Patent 196 41 973 A1, for example. As soon as the top sheet 11 has been removed from the stack and the device is sitting with the rollers 48 on the second sheet 12, the braking device 60 releases this second sheet 12 which is then the top sheet of the stack 10 so that it can be isolated for single feed and fed then either continuously or in response to an appropriate command in the same way.

A continuously rotating safety belt not shown made of a flexible material may also be placed around rollers 48. The width of the safety belt corresponds to the width of rollers 48, so that they do not act directly on top sheet 11, but instead they act on top sheet 11 only through the safety belt. The safety belt is wrapped loosely around the rollers 48 in the manner of a crawler chain with a track-laying vehicle. Then rollers 48 do not run on the top sheet 11 but instead run on the safety belt, which is in turn in contact with the top sheet 11 and is located between the rollers 48 and top sheet 11.

List of Reference Notation

| | |
|---|---|
| 10 | stack |
| 11 | top sheet |
| 12 | second sheet |
| 13 | third sheet |
| 20 | housing |
| 22 | supporting part |
| 24 | guide skid |
| 26 | bearing holes |
| 28 | shaft |
| 30 | shaft |
| 32 | deflecting toothed disks |
| 34 | toothed belt |
| 36 | bearing bushes |
| 38 | gripping jaws |
| 40 | sliding block |
| 42 | bearing bore |
| 44 | recesses |
| 46 | axles |
| 48 | rollers |
| 50 | electric motor |
| 52 | driven gear wheel |
| 54 | gear wheel |
| 56 | first section of 24 |
| 58 | second section of 24 |
| 60 | braking device |
| 62 | brake element |

What is claimed is:

1. A device for feeding sheets of a recording medium from a stack to an office machine, comprising: one or more shingling elements adapted to be moved along a non-circular path including a substantially linear portion extending parallel to the top sheet by one or more driven, continuously rotating traction belts in the feed direction over the respective top sheet of the stack, the shingling elements being in contact with the top sheet under pressure to separate the top sheet from the second sheet of the stack beneath it and displace the top sheet with respect to the second sheet in the direction of feed, wherein the shingling elements each have at least one roller arranged across the direction of feed, mounted so it can rotate freely on an axle, and the axle being secured on at least one traction belt and adapted to move slidably along at least one fixed, elongated guide skid extending in the feed direction, spaced apart from the top sheet and facing the top sheet of the stack.

2. A device according to claim 1, wherein the guide skid has a first section and a second section which follow one another in the direction of movement of the rollers, where the first section approaches the end of the top sheet in the direction of movement of the rollers, and the second section runs parallel to a plane of said direction of movement.

3. A device according to claim 2, wherein the rollers are arranged on the traction belts in such a number and at such a mutual spacing that at least one roller is in the area of the second section in each position of the traction belts.

4. A device according to claim 1, wherein the rollers are attached to the traction belt in such a way that the axles of the rollers lie in the plane of the traction means in which a tensile force is acting.

5. A device according to claim 1, wherein the traction belts are toothed belts.

6. A device according to claim 5, wherein the toothed belts include bearing bushes adapted to accommodate the axles on which the rollers are mounted.

7. A device according to claim 6, wherein the toothed belt is adapted to run over deflector toothed disks, the deflecting toothed disks having teeth with recesses with which the bearing bushes engage.

8. A device according to claim 6, characterized in that the bearing bushes each have a sliding block which slides on the respective guide skid.

9. A device according to claim 1, wherein a roller is arranged on each axle, extending over the entire width and designed with a camber.

10. A device according to claim 1, wherein the rollers have a jacket or a shell coating made of a soft elastic material.

11. A device according to claim 1, further comprising a braking device adapted to place a brake element on the rear edge of the second sheet of the stack in a controllable manner as soon as the top sheet of the stack has moved by a certain feed distance.

12. A device according to claim 1, further comprising a continuous safety belt placed around the rollers so that the rollers run on the safety belt, and the safety belt is between the rollers and the top sheet of the stack.

13. A method of separating a top sheet from a stack, comprising:

moving at least one shingling element along a non-circular path, said path including a substantially linear portion extending parallel to the top sheet in a direction of feed; and contacting said shingling element with the top sheet under pressure to separate the top sheet from the second sheet of the stack beneath it and displace the top sheet with respect to the second sheet in the direction of feed.

14. A device for feeding sheets of a recording medium from a stack to an office machine, comprising:

at least one shingling element adapted to be moved along a non-circular path including a substantially linear portion extending parallel to the top sheet in a direction of feed; and shingling element driving means for moving said shingling element in the feed direction over the top sheet of the stack, wherein the shingling element is adapted to contact the top sheet under pressure to separate the top sheet from the second sheet of the stack beneath it and displace the top sheet with respect to the second sheet in the direction of feed.

* * * * *